US011020769B2

(12) United States Patent
Savage

(10) Patent No.: US 11,020,769 B2
(45) Date of Patent: Jun. 1, 2021

(54) NUT SORTER

(71) Applicant: SAVAGE EQUIPMENT INCORPORATED, Madill, OK (US)

(72) Inventor: Basil W. Savage, Madill, OK (US)

(73) Assignee: Savage Equipment Incorporated, Madill, OK (US)

( * ) Notice: Subject to any disclaimer, the term of this patent is extended or adjusted under 35 U.S.C. 154(b) by 1203 days.

(21) Appl. No.: 15/340,754

(22) Filed: Nov. 1, 2016

(65) Prior Publication Data

US 2018/0117632 A1 May 3, 2018

(51) Int. Cl.
*B07B 1/22* (2006.01)
*B07B 1/52* (2006.01)

(52) U.S. Cl.
CPC ..... *B07B 1/22* (2013.01); *B07B 1/526* (2013.01)

(58) Field of Classification Search
CPC ..... B07B 1/22; B07B 1/526
USPC ..... 207/567; 209/627
See application file for complete search history.

(56) References Cited

U.S. PATENT DOCUMENTS 2,161,032 A * 6/1939 Formway ..... A23N 5/01 99/591
2,669,268 A * 2/1954 Meyer ..... A23N 5/01 99/569
4,205,882 A * 6/1980 Hauschopp ..... E21C 35/12 299/43
4,673,502 A * 6/1987 Fox ..... B01D 29/15 210/413
4,702,826 A * 10/1987 Pogue ..... B07B 1/22 209/237
5,329,845 A * 7/1994 Bichel ..... A23N 5/002 99/627
5,467,700 A 11/1995 Dowell et al.
6,360,894 B1 * 3/2002 Devlin ..... B07B 1/22 209/291
6,824,804 B2 11/2004 Broyles et al.
6,941,859 B2 * 9/2005 Trujillo ..... A23N 5/08 99/523
7,302,886 B2 * 12/2007 Hamilton ..... A23N 5/01 99/606
7,444,929 B1 * 11/2008 Savage ..... A23N 5/00 99/569
2010/0078366 A1 * 4/2010 Wark ..... B07B 1/12 209/627

OTHER PUBLICATIONS

Images of prior art nut sorter (undated but admitted to be prior art).

(Continued)

*Primary Examiner* — Charles A Fox
*Assistant Examiner* — Michael E Butler
(74) *Attorney, Agent, or Firm* — McAfee & Taft

(57) ABSTRACT

A nut sorter includes a support frame with a rotatable cage connected thereto. The rotatable cage is comprised of support rings with a plurality of longitudinally extending rods connected thereto. The outer periphery of the longitudinally extending rods extends inwardly into a center space defined by the inner diameter of the support rings. The nut sorter also has a plurality of scrapers utilized to dislodge stuck debris and nuts as the cage rotates under the scrapers.

13 Claims, 8 Drawing Sheets

(56) References Cited

OTHER PUBLICATIONS

United States Department of Agriculture, Agricultural Marketing Service, Fruit and Vegetable Division, Fresh Products Branch, "Pecans in the Shell," Washington, D. C., Feb. 1968, Reprinted Oct. 2002.
Image of a prior art nut sorter (undated but admitted to be prior art).
Image of a scraper on a prior art nut sorter (undated but admitted to be prior art).

* cited by examiner

NUT SORTER

BACKGROUND

A variety of different pieces of equipment are utilized in the processing of nuts, for example, pecans, that have been harvested. One of those pieces of equipment may be referred to as a nut sorter or nut sizer. One type of nut sorter may be referred to as a reel sorter or reel sizer. The reel sizer includes a rotating cage with a plurality of spaced-apart longitudinal rods. The rods are spaced to allow nuts less than the desired size to pass therethrough. Current nut sizers, however, have some obstructions within the cage that oftentimes create a buildup of nuts or a slow flow through the nut sizer. The disclosure herein is directed to a nut sizer that has no obstructions in the cage in which the nuts pass, and has an improved scraper assembly.

BRIEF DESCRIPTION OF THE DRAWINGS

FIGS. 6A and 6B are cross sections from lines 6A-6A and 6B-6B of FIG. 1.

SUMMARY

The nut sorter of the current disclosure comprises a frame with a rotatable cage supported thereby. The rotatable cage includes a plurality of support rings having an outer diameter and an inner diameter. A plurality of longitudinally extending spaced-apart rods are connected to the support rings. The support rings have an inner diameter that defines a center opening. The outermost periphery of the rods is positioned such that it extends radially inwardly into the center opening. The rods are circular rods. The circumference of the circular rods extends into the center opening defined by the inner diameter of the support rings. Thus there are no obstructions to prevent nuts from passing from an entry or supply end to the discharge end in the rotatable cage.

A plurality of scrapers are configured to engage the rotatable cage. The scrapers are configured to dislodge any nuts and/or debris that are stuck in the spaces between the longitudinal rods. The scrapers comprise a flat plate with flat upper and lower surfaces. The scrapers are hingeless but are pivotable. The scrapers rest on and are supported by a beam with a tilted, or slanted upper surface. The slanted upper surface is flat and slants upwardly from the discharge end to the supply end. As a result, nuts are directed from the supply end to the discharge end. The scrapers are connected to a cap that is spaced from, and parallel to the slanted upper surface. The scrapers will pivot about pins that extend through the cap and through the scrapers. The scrapers have slots therein through which the pins extend to allow pivoting and to allow an up and down or floating movement as well.

DESCRIPTION OF AN EMBODIMENT

Figure 1:
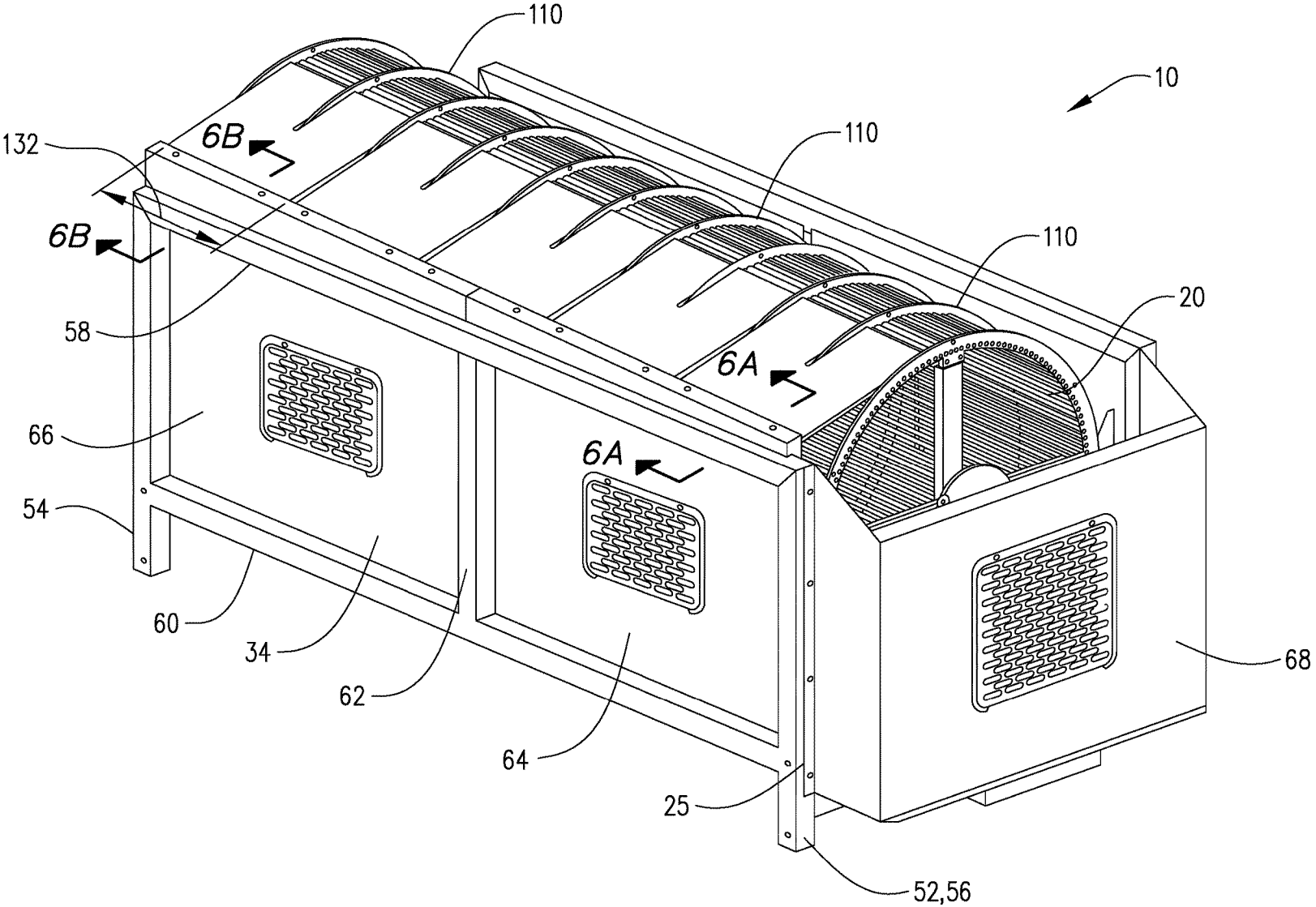
FIG. 1 is a perspective showing a discharge and left side of the nut sorter.
Figure 2:
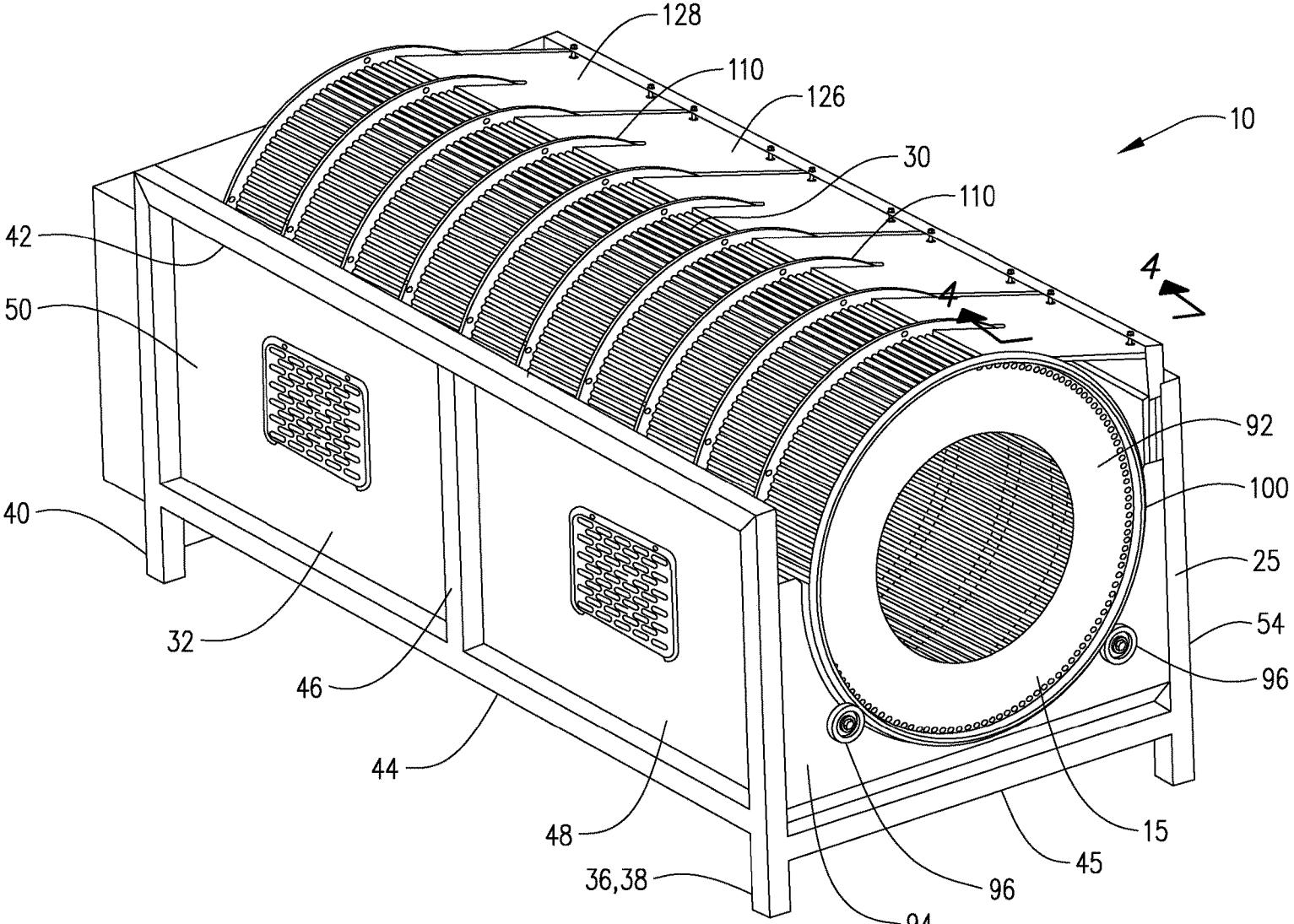
FIG. 2 is a perspective showing the supply end and left side of the nut sorter.

Referring now to the figures and more particularly to FIG. 1 and FIG. 2, a nut sorter, or nut sizer 10 of the current disclosure is shown. Nut sorter 10 has a first or supply end 15 and a second or discharge end 20. Nut sorter 10 includes a support frame 25 and a rotatable cage 30. In operation, nuts are fed into supply end 15. Rotatable cage 30 is tilted so that nuts will pass from supply end 15 to discharge end 20. The rotatable cage 30 is configured such that nuts smaller than the desired size will pass through the rotatable cage 30 prior to reaching the discharge end 20. Ultimately, all or most of the nuts that exit through discharge end 20 will be at or above the desired size.

Support frame 25 includes left side 32 and right side 34. Left side 32 has vertical support legs 36 which may comprise a forward and rear support leg 38 and 40 respectively. Vertical support legs may be any desired height to provide for delivery through discharge end 20. Left side 32 further includes an upper longitudinal support beam 42 extending between and connected to the forward and rear vertical support legs 38 and 40. Likewise, a lower longitudinal support beam 44 extends between vertical support legs 38 and 40 and is connected thereto. An intermediate vertical support beam 46 spans the distance or height between the upper and lower longitudinal support beams 42 and 44 respectively. First and second panels 48 and 50 may be connected to the vertical support legs 38 and 40 and upper and lower longitudinal support beams 42 and 44 respectively.

Right side 34 of the support frame likewise has vertical support legs 52 which may comprise a forward vertical support leg 54 and rear vertical support leg 56. Upper and lower longitudinal support beams 58 and 60 extend between and are connected to the forward and rear vertical support legs 54 and 56 respectively. A center vertical support beam 62 may be connected to the upper and lower longitudinal support beams 58 and 60 to provide support thereto. Right side 34 includes first and second panels 64 and 66 respectively. A shield 68 may be connected to vertical support legs 56 and 40. Shield 68 will cover a motor as will be described herein that is utilized to rotate rotatable cage 30. A lateral support beam 45 may extend between vertical support legs 36 and 54 at forward end 15. A lateral support beam 69 may extend between vertical support legs 40 and 56 at rear end 20.

Figure 3:
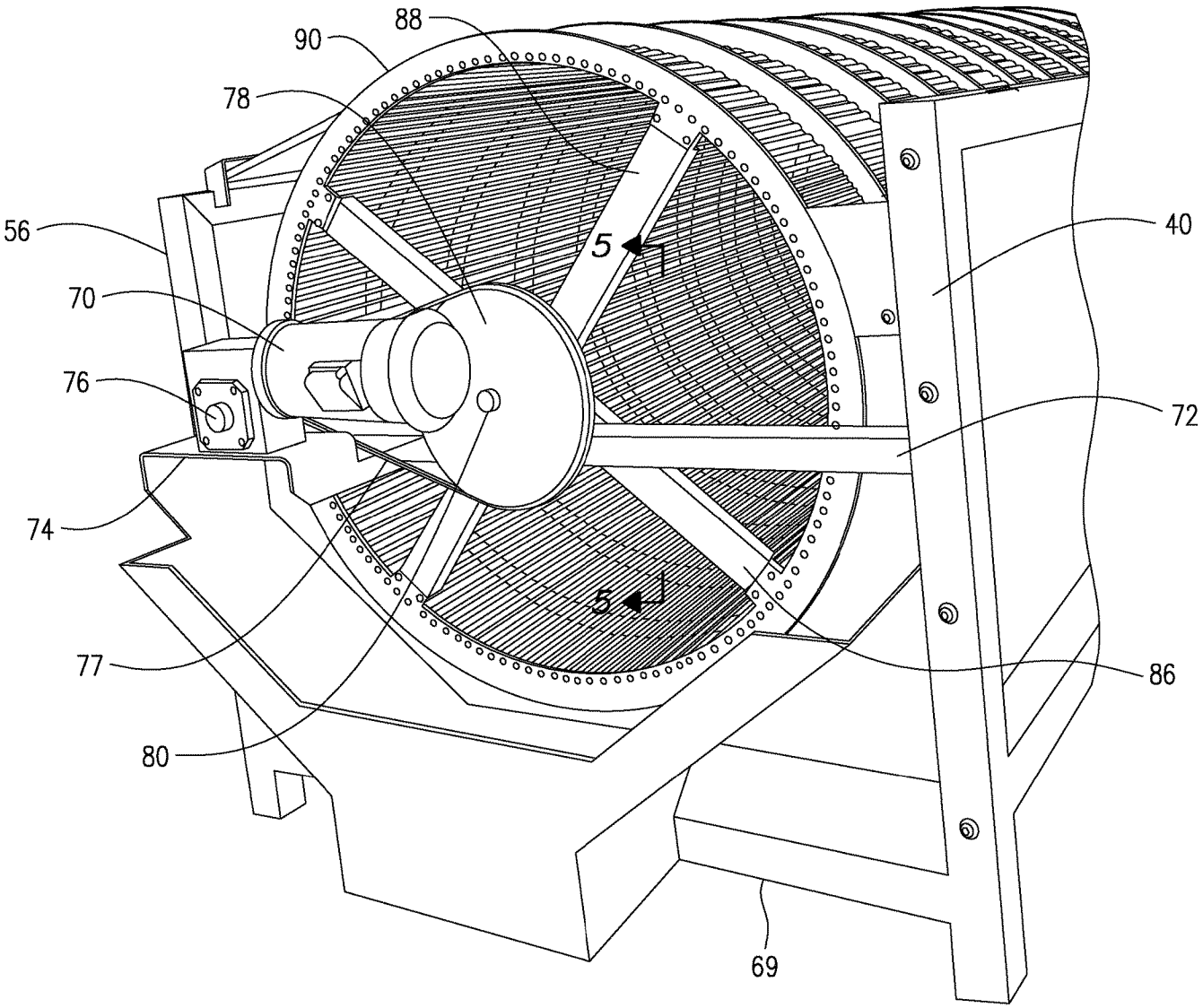
FIG. 3 is a view with the end shield removed.
Figure 4:
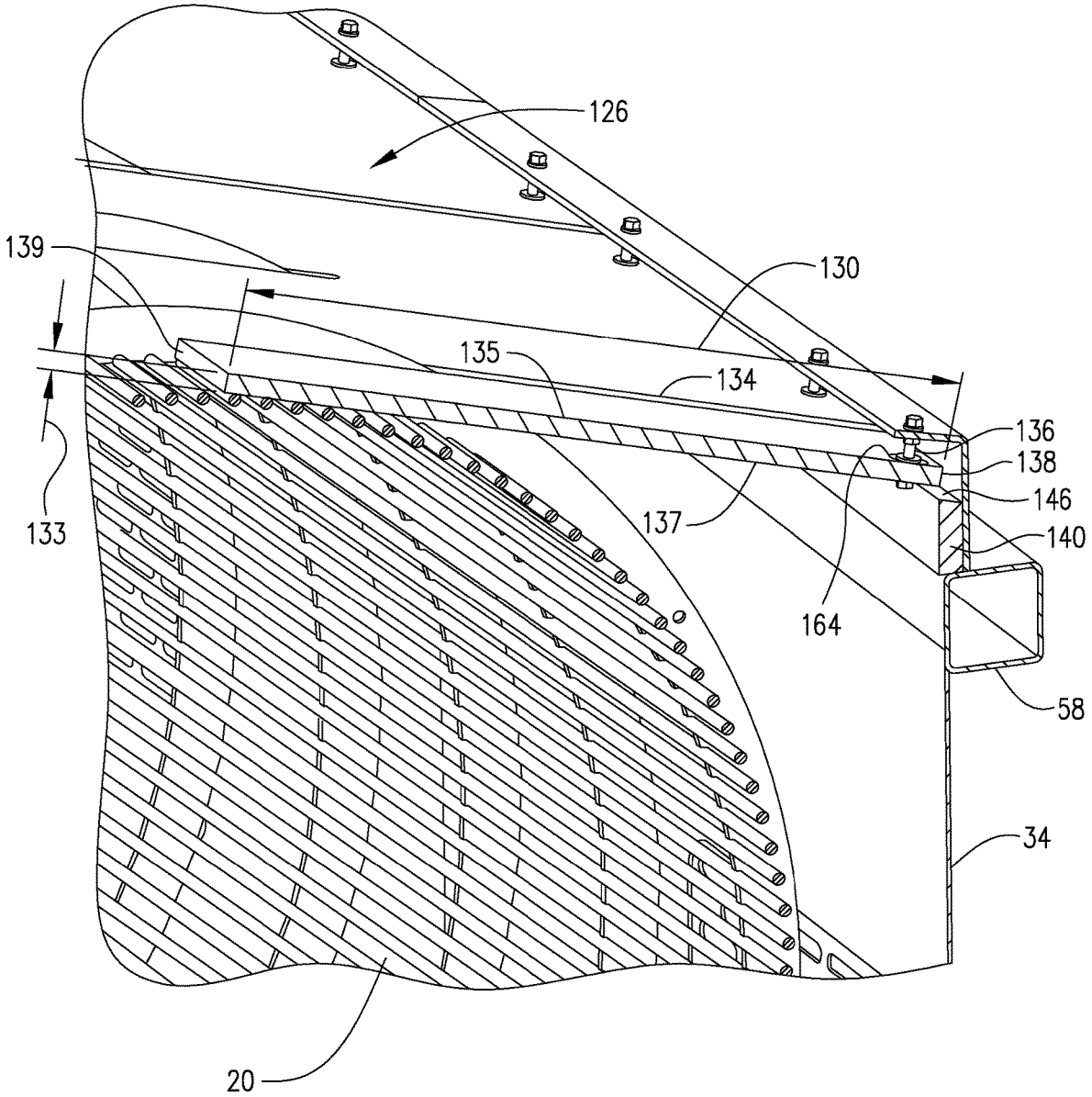
FIG. 4 a cross section from lines 4-4 of FIG. 2.
Figure 5:
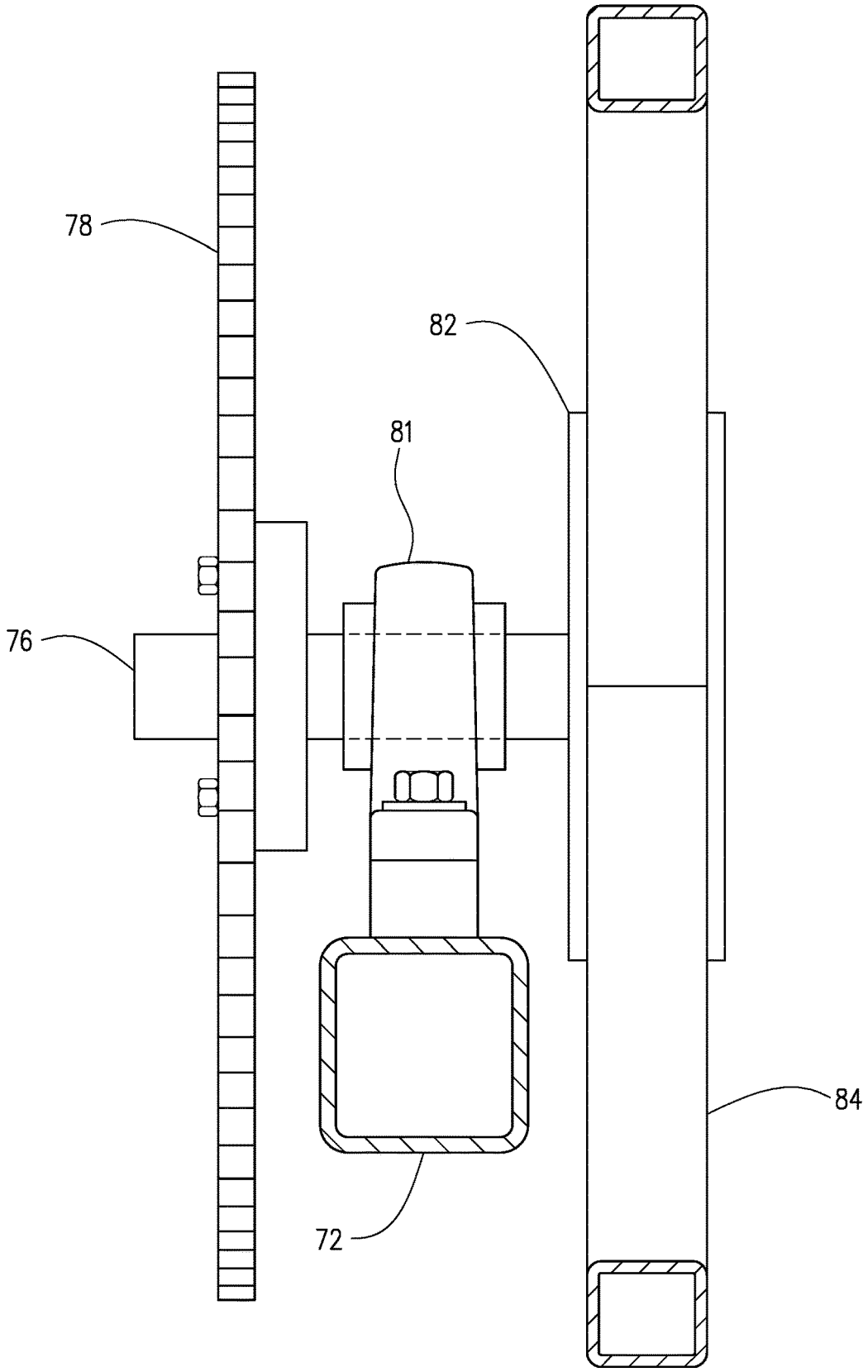
FIG. 5 is a cross section from lines 5-5 of FIG. 3.
Figure 5B:
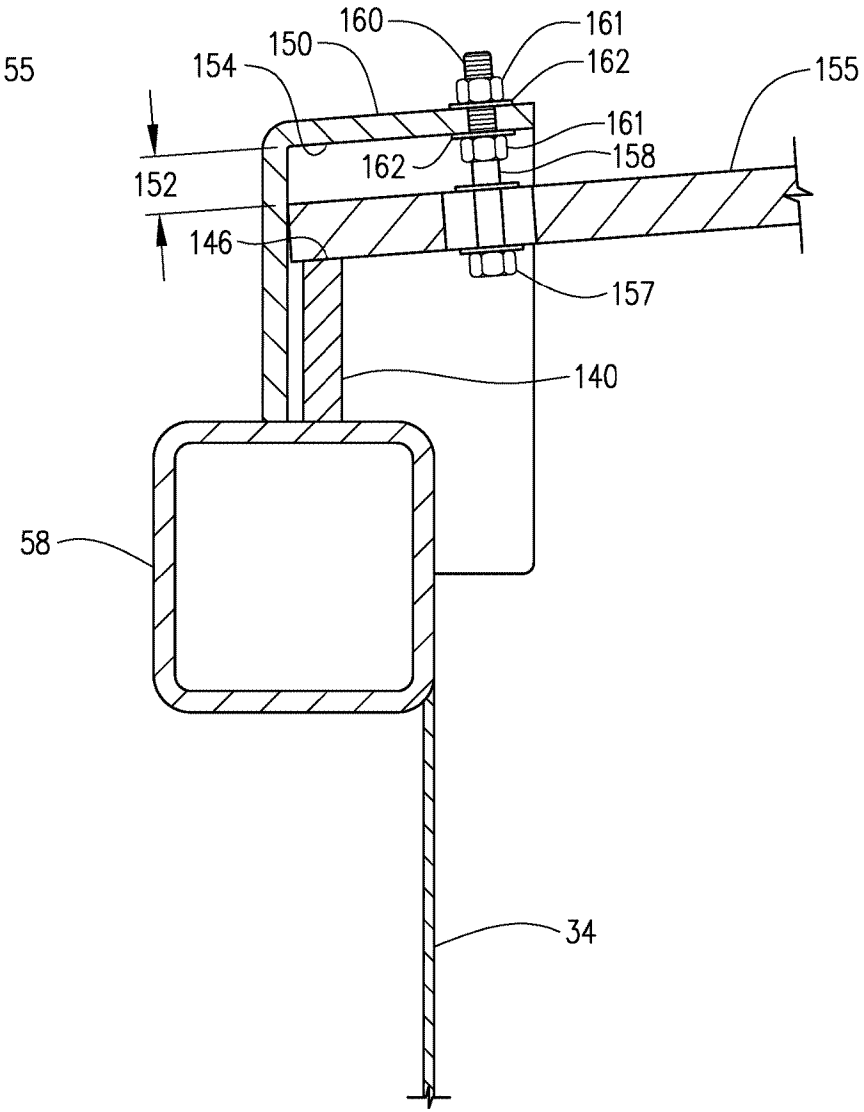
Figure 5A:
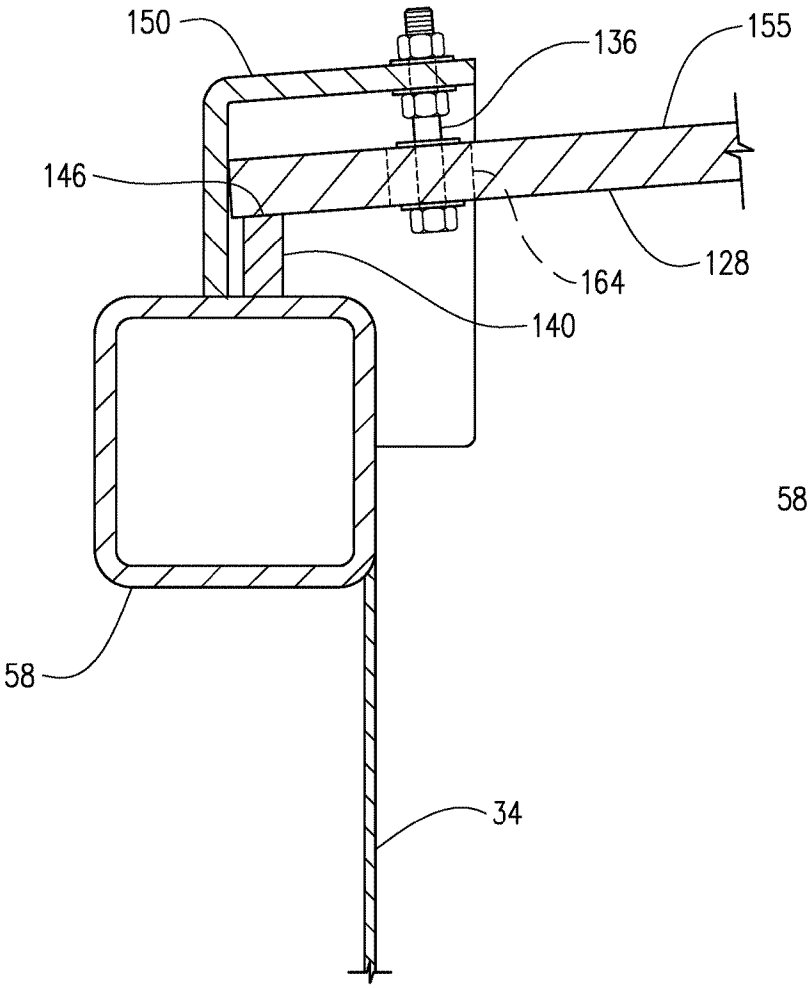
Figure 7:
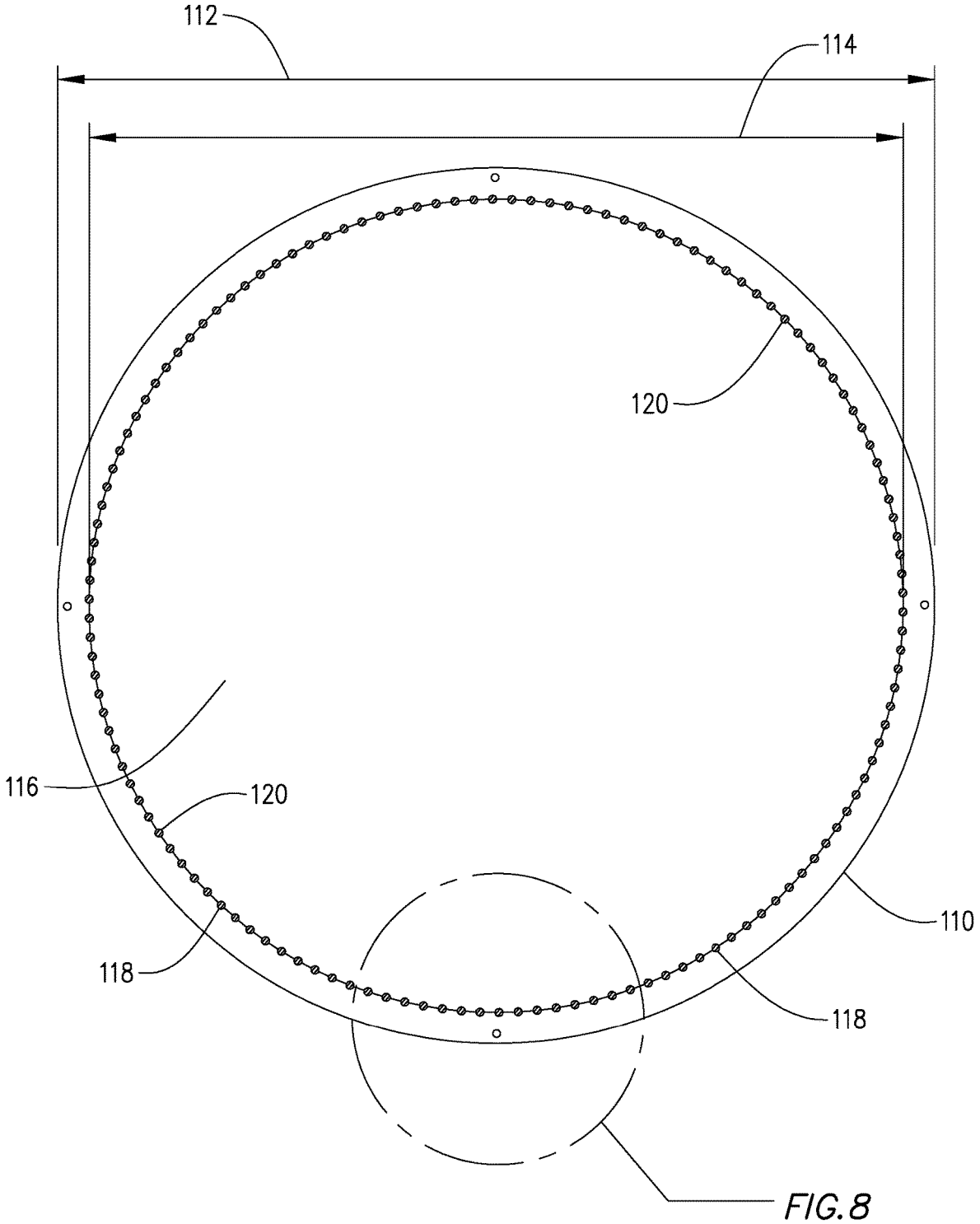
FIG. 7 is a front view of a support ring with spacer rods attached thereto.

Referring now to FIGS. 3 and 5, a motor 70 is utilized to rotate rotatable cage 30. A cross brace 72 extends between the vertical support legs 40 and 56 and may be welded or otherwise connected thereto. A platform 74 is connected to cross brace 72 to provide a platform for motor 70. A shaft 76 will extend through motor 70 and will be rotated thereby. A chain 77 will extend around a sprocket extending from motor 70 (not shown) and around a second sprocket 78 to rotate sprocket 78. A shaft 80 is rotated with sprocket 78 and extends through a bearing 81 mounted to cross brace 72. Shaft 80 may be connected to a rotator assembly 84 which includes a plate 82 to which shaft 80 is connected. Plate 82 is connected to cross beams 86 and 88. As a result, cross beams 86 and 88 rotate with shaft 80. Cross beams 86 and 88 are connected to an end ring, which may be referred to as a rear end ring 90 of rotatable cage 30. Rotation of cross beams 86 and 88 will rotate rear end ring 90, which will rotate cage 30. Rotatable cage 30 likewise includes a forward end ring 92. A forward support panel 94 is connected to and extends between vertical support legs 36 and 54 at the forward end 15. Support panel 94 has a pair of support bearings 96 mounted thereto. A bearing ring 100 may be attached to forward end ring 92. Bearing ring 100 will ride on and be supported by bearings 96 as forward end ring 92 rotates.

Figure 8:
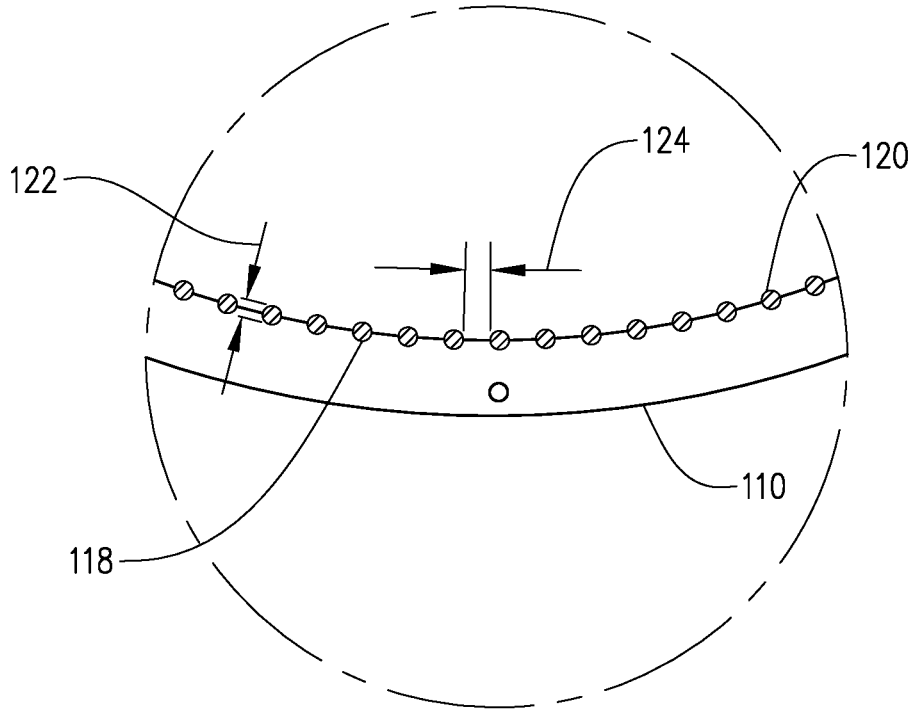
FIG. 8 is a close-up of a portion of a support ring.

Referring now to FIG. 8, a support ring 110 is shown. Rotatable cage 30 includes a plurality of support rings 110 that are spaced apart longitudinally from forward end 15 to rear end 20 and are positioned between the forward and rear support rings 92 and 90 respectively. Each of support rings 110 has an outer diameter 112 and an inner diameter 114 which defines the central opening 116.

Figure 9:
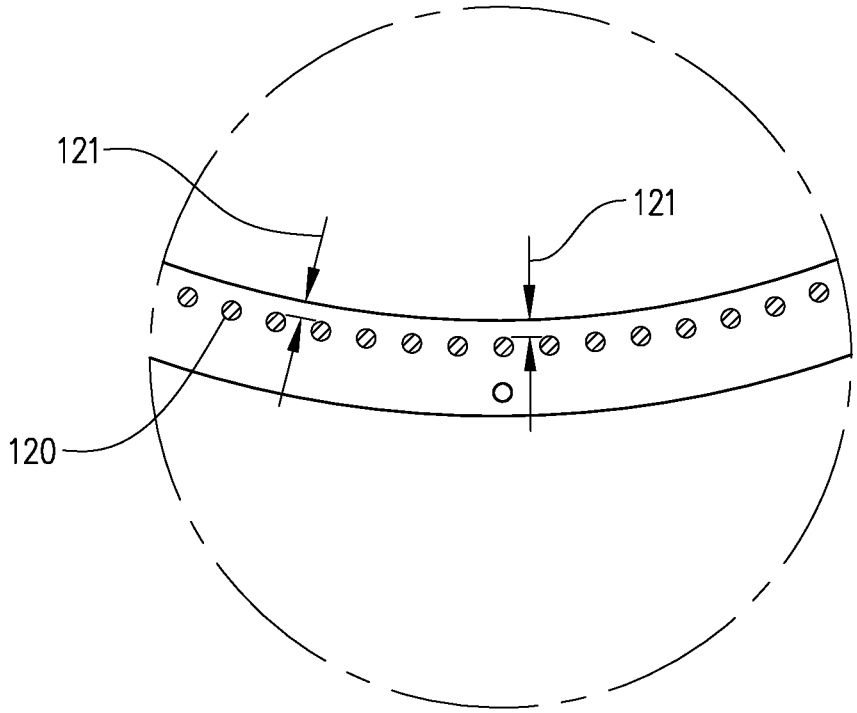
FIG. 9 PRIOR ART
FIG. 9 is a prior art version of a support ring.

Notches 118 will each have a longitudinal support rod 120 connected therein by welding or other means known in the art. Longitudinal support rods 120 are connected by welding or otherwise to forward and rear support rings 92 and 90 respectively. Rotatable cage 30 includes a plurality of longitudinal rods 120 having an outer diameter 122. As is apparent from the drawings, outer diameter 122 extends radially inwardly from inner diameter 114 of support rings 110 and thus extends into central, or center opening 116. As a result, there is no ridge or other obstruction created by the connection of rods 120 to support rings 110 as was the case with prior art nut sorters. For example, as shown in FIG. 9, prior art sorters include rings with spacer rods inserted through and connected to openings radially outward from an inner diameter of the rings. The resulting ridge 121 created a stop, or obstruction which would slow or stop the flow of nuts through the sorter. No such issue exists with the nut sorter 10, since there are no ridges or other obstructions to the nut flow. Referring now to FIG. 8, longitudinal rods 120 have a space 124 which will be a general uniform space 124 therebetween. Space 124 is configured such that sizes below a specified size will fall through space 124 between longitudinal rods 120. As a result, only nuts at or above the specified size will pass through discharge end 20.

Nut sorter 20 also includes a scraper assembly 126. Scraper assembly 126 is utilized to dislodge nuts and/or debris that may be caught and stuck between longitudinal rods 120. Thus, as the cage 30 rotates, the scraper assembly 126 will engage and dislodge any stuck nuts and/or debris.

Scraper assembly 126 comprises a plurality of individual scrapers 128. Scrapers may be, for example, a flat plate with a length 130, a width 132, a thickness 133 and upper and lower surfaces 135 and 137 respectively. Scrapers 128 define slots 134 therethrough to provide a space for a support ring 110 to rotate and pass therethrough. Scrapers 128 will float, or bounce on rods 120 as the cage 30 rotates. This will aid in dislodging any stuck debris and/or nuts. In addition, the scrapers 128 will pivot about pins 136 that pass therethrough near an outer edge 138 thereof. Scrapers 128 likewise have an inner edge 139.

Scraper assembly 126 and thus individual scrapers 128 are supported by a slanted or tilted support beam 140. Tilted support beam 140 extends from a first end at the supply end 15 of nut sorter 10 to a second end at the discharge end 20 of nut sorter 15. Tilted beam 140 has a tilted or slanted upper surface 146. Slanted surface 146 slants upwardly from discharge end 20 towards supply end 15. As depicted in FIGS. 6A and 6B, the height of tilted support beam 140 increases from the rear end 20 to forward end 15. Tilted or slanted surface 146 is a generally flat surface. Scraper assembly 126 and thus individual scrapers 128 rest on and are supported by the slanted upper surface 146 of tilted support beam 140. However, in the disclosure herein, the scrapers 128 are not connected to tilted support beam 140. Instead, individual scrapers 128 are movably connected to a cap 150.

Cap 150 likewise is on an upward slant from rear end 20 to forward end 15 and may generally be parallel to the slanted upper surface 146 of beam 140. Cap 150 may be welded or otherwise connected to upper longitudinal support beam 58. Cap 150 may essentially be one leg of a generally L-shaped beam that is connected to upper longitudinal support beam 58. A space 152 is defined by and between the upper surface 155 of scrapers 128 and a lower surface 154 of cap 150. Each scraper 128 is connected, or mounted to cap 150 with at least one pin 136 and preferably with a pair of pins 136. Pins 136 will be located near the outer edge 138 of each scraper 128. Pins 136 may comprise a pin with a head 157, and a smooth shank 158 extending through the scraper 128. Thus, pins 136 have a smooth shank portion 158 and a threaded portion 160. Threaded portion 160 will extend through cap 150. Nuts 161 will be threaded above and below cap 150. Washers 162 may be placed underneath both of nuts 161. Likewise, a washer may be placed on the upper surface 155 of scraper 128. Pins 136 will pass through slots 164 defined in the scrapers 128.

In operation, nuts will be provided to supply end 15. The rotatable cage 30 is a tilted cage such that nuts will be directed toward discharge end 20. Motor 70 will cause rotatable cage 30 to rotate so that the nuts will be moved toward discharge end 20. Nuts of less than a desired size will fall through the spaces 124 defined between longitudinal rods 120. Any nuts or debris caught in the space 124 that rotate upwardly will be knocked loose by scrapers 128. Scrapers 128 pivot about pins 136 and are allowed to float as well. The size or space 124 between longitudinal rods 120 will be determined based on a desired size of nut to be delivered to discharge end 20. For example, the pecan industry generally uses sizing reels with slot openings of various widths measured in 1/16 inch increments. Thus, a size 10 has a 10/16 inch width while a size 16 has a 16/16 or 1 inch width. The spaces are thus defined so that anything below a particular size, for example, a size 10 will fall therethrough. Thus, only nuts of the desired size, in this example a size 10 or above, will pass through discharge end 20 and will be collected for further processing. All other debris and smaller nuts will pass through the spaces 124 and be caught in a bin or other structure below rotatable cage 30 utilized for such purposes.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A nut sorter comprising:

a frame; and a rotatable cage supported by the frame, the rotatable cage having a supply end and a discharge end, the rotatable cage comprising:

a plurality of support rings having an outer diameter and an inner diameter;

a plurality of longitudinally extending spaced-apart circular rods connected to the support rings, wherein a portion of the circumference of the circular rods is positioned radially inwardly from the inner diameter of the support rings, the spaced-apart rods having a space therebetween of a predetermined size that prevents nuts of a desired size from falling therethrough and delivers the nuts of the desired size to the discharge end, and that allows debris and undersized nuts to pass therethrough; and first and second end rings, the longitudinally extending rods being connected to the first and second end rings, and the support rings being spaced apart between the end rings; and a plurality of scrapers connected to the frame, the scrapers configured to engage the circular rods, wherein the scrapers engage the rods above the longitudinal center line of the rotatable cage.

2. The nut sorter of claim 1, each scraper comprising a single plate pivotable about at least one pivot pin extending therethrough.

3. The nut sorter of claim 1, wherein each scraper has two pivot pins extending therethrough.

4. The nut sorter of claim 1, the scrapers each having at least one slot defined therein, the nut sorter further comprising a pin extending through the slot, where the scraper will float on the pin as the rotatable cage rotates.

5. A nut sorter comprising:

a frame;

a rotatable cage mounted to the frame, the rotatable cage comprising a plurality of circular support rings and longitudinally extending spaced-apart rods; and a plurality of scrapers configured to engage the longitudinally extending spaced apart rods of the rotating cage and release nuts stuck between the rods, wherein the scraper will float on the rods as the rods pass thereunder, and wherein the scrapers comprise flat hingeless plates.

6. The nut sorter of claim 5 further comprising a tilted support beam configured to support the scrapers, wherein the scrapers rest on but are disconnected from the tilted support beam.

7. The nut sorter of claim 6 further comprising a cap vertically spaced from the tilted support beam, the scrapers being connected to the cap.

8. The nut sorter of claim 7 further comprising a plurality of pins connecting the scrapers to the cap, wherein the scrapers pivot about the pins.

9. The nut sorter of claim 5, wherein the plurality of circular support rings have inner and outer diameters and wherein the spaced-apart rods are connected to the support rings.

10. The nut sorter of claim 9, wherein the outer periphery of the spaced-apart rods extends into a center opening defined by the inner diameter of the support rings.

11. A nut sorter comprising:

a frame;

a rotatable cage mounted to the frame, the rotatable cage comprising a plurality of circular support rings and longitudinally extending spaced-apart rods;

a plurality of scrapers configured to engage the rotating cage and release nuts stuck between the rods, wherein the scraper will float on the rods as the rods pass thereunder, and wherein the scrapers comprise flat hingeless plates; and a tilted support beam configured to support the scrapers, wherein the scrapers rest on but are disconnected from the tilted support beam.

12. The nut sorter of claim 11 further comprising a cap vertically spaced from the tilted support beam, the scrapers being connected to the cap.

13. The nut sorter of claim 11, the longitudinal rods having a space of a predetermined size therebetween to prevent nuts of a desired size from falling therethrough.

* * * * *